US012251608B2

(12) United States Patent
St-Laurent et al.

(10) Patent No.: US 12,251,608 B2
(45) Date of Patent: Mar. 18, 2025

(54) BALL BATS WITH INNER BARREL STRUCTURES

(71) Applicant: RAWLINGS SPORTING GOODS COMPANY, INC., St. Louis, MO (US)

(72) Inventors: Frederic St-Laurent, Simi Valley, CA (US); Michael Haas, West Salem, WI (US); Ian Montgomery, Simi Valley, CA (US); Rebecca S. O'Hara, University City, MO (US); Linda Hunt, Simi Valley, CA (US); Douglas Wade Heimer, Caledonia, MN (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 438 days.

(21) Appl. No.: 17/647,433

(22) Filed: Jan. 7, 2022

(65) Prior Publication Data

US 2023/0218963 A1 Jul. 13, 2023

(51) Int. Cl.

| | |
|---|---|
| ***A63B 60/54*** | (2015.01) |
| ***A63B 60/16*** | (2015.01) |
| ***A63B 102/18*** | (2015.01) |

(52) U.S. Cl.

CPC ..... *A63B 60/54* (2015.10); *A63B 60/16* (2015.10); *A63B 2102/18* (2015.10); *A63B 2102/182* (2015.10)

(58) Field of Classification Search

CPC ..... A63B 60/54; A63B 60/16; A63B 2102/18; A63B 2102/182; A63B 59/56;

(Continued)

(56) References Cited

U.S. PATENT DOCUMENTS 2,967,710 A 1/1961 Carlson
3,623,724 A 11/1971 Lande (Continued)

FOREIGN PATENT DOCUMENTS

JP 2001095968 A 4/2001
JP 2004275742 A 10/2004

(Continued)

OTHER PUBLICATIONS

Boombah , "2017 Boombah Boss Compressor T3 Bat Review", YouTube Video; URL: https:/Awww.youtube.com/watch?v=aAFJAPKIISA, Jun. 2, 2017 (Year: 2017).*

(Continued)

*Primary Examiner* — Jeffrey S Vanderveen
(74) *Attorney, Agent, or Firm* — Perkins Coie LLP

(57) ABSTRACT

Representative embodiments of the present technology include a bat having a barrel shell and a frame structure. The barrel shell may include a barrel region of the bat and part of a tapered region of the bat. The frame structure may include a first portion positioned outside the barrel shell and a second portion positioned inside the barrel shell. In some embodiments, a distal end of the frame structure is in the barrel region but is longitudinally spaced from a distal end of the barrel shell. In some embodiments, the distal end of the frame structure is longitudinally spaced from an end cap of the bat. The barrel shell may flex or pivot relative to the second portion of the frame structure. In some embodiments, the only connection between the frame structure and the barrel shell within the barrel shell may be within the tapered region.

22 Claims, 4 Drawing Sheets

(58) Field of Classification Search
CPC ..... A63B 59/51; A63B 59/54; A63B 60/002; A63B 2209/00; A63B 59/50; A63B 2209/02; A63B 2209/14
See application file for complete search history.

(56) References Cited

U.S. PATENT DOCUMENTS 3,877,698 A 4/1975 Volpe
3,990,699 A 11/1976 Urmston
4,206,150 A 6/1980 Slaugh
4,331,330 A 5/1982 Worst
4,671,511 A 6/1987 Trysinsky
4,930,772 A 6/1990 Maloney et al.
4,951,948 A * 8/1990 Peng ..... A63B 59/50 267/136
5,050,877 A 9/1991 Wales
5,104,123 A 4/1992 Okitsu et al.
5,219,164 A 6/1993 Peng
5,415,398 A 5/1995 Eggiman
5,511,777 A 4/1996 Mcneely
5,593,158 A * 1/1997 Filice ..... A63B 60/08 473/566
5,676,610 A 10/1997 Bhatt et al.
5,899,823 A 5/1999 Eggiman
5,964,673 A 10/1999 Mackay, Jr.
6,022,282 A 2/2000 Kennedy et al.
6,053,828 A 4/2000 Pitsenberger
6,077,178 A 6/2000 Brandt
6,159,114 A 12/2000 Degaris
6,176,795 B1 1/2001 Schullstrom
6,251,034 B1 6/2001 Eggiman et al.
6,287,222 B1 9/2001 Pitsenberger
6,398,675 B1 6/2002 Eggiman et al.
6,425,836 B1 7/2002 Misono et al.
6,461,260 B1 10/2002 Higginbotham
6,497,631 B1 12/2002 Fritzke et al.
6,533,685 B1 3/2003 Otten et al.
6,612,945 B1 9/2003 Anderson
6,663,517 B2 12/2003 Buiatti et al.
6,723,012 B1 4/2004 Sutherland
6,733,404 B2 5/2004 Fritzke et al.
6,761,653 B1 7/2004 Higginbotham et al.
6,869,372 B1 3/2005 Higginbotham et al.
6,945,886 B2 9/2005 Eggiman et al.
6,949,038 B2 9/2005 Fritzke
6,969,330 B1 11/2005 Meeker
6,997,826 B2 2/2006 Sutherland
7,014,580 B2 3/2006 Forsythe et al.
7,033,291 B1 4/2006 Meeker
7,044,871 B2 5/2006 Sutherland et al.
7,097,578 B2 8/2006 Guenther et al.
7,128,670 B2 10/2006 Souders et al.
7,311,620 B1 * 12/2007 Heald ..... A63B 59/50 473/566
7,320,653 B2 1/2008 Fitzgerald et al.
7,377,866 B2 * 5/2008 Van Nguyen ..... A63B 60/54 473/566
7,527,570 B2 5/2009 Giannetti et al.
7,572,197 B2 8/2009 Chauvin et al.
7,585,235 B2 9/2009 Misono et al.
7,651,420 B1 1/2010 Gaff et al.
7,699,725 B2 4/2010 Mcnamee et al.
7,749,115 B1 * 7/2010 Cruz ..... A63B 60/00 473/566
7,798,926 B1 9/2010 Hsu
7,850,554 B2 12/2010 Burger
7,867,114 B2 1/2011 Sutherland et al.
7,980,970 B2 7/2011 Watari et al.
7,985,149 B2 7/2011 Watari et al.
7,993,223 B2 8/2011 Watari et al.
8,007,381 B2 8/2011 Watari et al.
8,029,391 B2 10/2011 Mcnamee et al.
8,313,397 B2 11/2012 Watari et al.
8,449,412 B2 5/2013 Vander et al.
8,480,519 B2 7/2013 Chauvin et al.
8,632,428 B2 1/2014 Burger
9,005,056 B2 4/2015 Pegnatori
9,067,109 B2 6/2015 Epling et al.
9,149,697 B2 10/2015 Epling et al.
9,498,690 B2 11/2016 Carlson et al.
9,669,277 B1 6/2017 Haas et al.
10,220,277 B1 3/2019 Hunt et al.
10,561,914 B2 * 2/2020 Tsukamoto ..... A63B 59/50
10,688,358 B2 6/2020 Hunt et al.
10,773,138 B2 9/2020 Epling et al.
11,058,934 B2 7/2021 Goodwin et al.
11,097,171 B2 8/2021 Pegnatori
2002/0016230 A1 2/2002 Okuyuma et al.
2002/0091022 A1 7/2002 Fritzke et al.
2002/0094892 A1 7/2002 Chauvin et al.
2004/0152545 A1 8/2004 Fritzke
2004/0166970 A1 8/2004 Sutherland
2004/0209711 A1 10/2004 Liberatore
2004/0209716 A1 10/2004 Vacek et al.
2005/0143203 A1 * 6/2005 Souders ..... A63B 59/50 473/564
2005/0221924 A1 * 10/2005 Sutherland ..... A63B 60/54 473/566
2006/0258490 A1 11/2006 Fitzgerald et al.
2007/0155546 A1 7/2007 Chauvin et al.
2007/0202973 A1 8/2007 Van
2007/0219027 A1 9/2007 Chong et al.
2008/0064538 A1 * 3/2008 McNamee ..... A63B 60/16 473/564
2008/0070726 A1 3/2008 Watari et al.
2009/0215559 A1 8/2009 Mcnamee et al.
2009/0280934 A1 11/2009 Watari et al.
2009/0280935 A1 11/2009 Watari et al.
2010/0029418 A1 2/2010 Chen
2010/0113194 A1 5/2010 Tokieda
2010/0125014 A1 5/2010 Watari et al.
2011/0105255 A1 5/2011 Watari et al.
2011/0172038 A1 * 7/2011 Watari ..... A63B 59/50 473/564
2011/0281674 A1 * 11/2011 Shindome ..... A63B 59/56 473/564
2012/0108371 A1 * 5/2012 Epling ..... A63B 59/51 473/566
2012/0184402 A1 7/2012 Mcnamee et al.
2013/0267358 A1 10/2013 Vaccaro
2014/0073464 A1 3/2014 Van Nguyen
2014/0080641 A1 3/2014 Epling et al.
2014/0080642 A1 3/2014 Epling et al.
2014/0272245 A1 9/2014 Livingston-Peters et al.
2014/0342855 A1 * 11/2014 Thurman ..... G06Q 30/0621 473/564
2015/0005114 A1 1/2015 Tsukamoto et al.
2015/0040349 A1 2/2015 Malia et al.
2015/0105189 A1 4/2015 Schullstrom
2015/0157908 A1 6/2015 Van Nguyen et al.
2015/0273295 A1 * 10/2015 Haas ..... A63B 59/50 473/520
2015/0360104 A1 12/2015 Chauvin et al.
2016/0184680 A1 * 6/2016 Van Nguyen ..... A63B 59/54 29/527.1
2017/0340935 A1 11/2017 Gray et al.
2018/0093148 A1 * 4/2018 Tsukamoto ..... A63B 60/00
2018/0169491 A1 * 6/2018 Gray ..... A63B 59/50
2019/0015720 A1 * 1/2019 Van Nguyen ..... A63B 60/14
2019/0143185 A1 * 5/2019 Hunt ..... A63B 60/08 473/564
2019/0344140 A1 11/2019 Chauvin et al.
2020/0070021 A1 * 3/2020 Gray ..... A63B 60/54
2020/0330838 A1 * 10/2020 Goodwin ..... A63B 59/54
2020/0398128 A1 * 12/2020 Hunt ..... A63B 59/54
2021/0268352 A1 9/2021 Montgomery et al.
2022/0040547 A1 2/2022 Yim et al.
2022/0226708 A1 * 7/2022 Ellington ..... A63B 59/50

(56) References Cited

U.S. PATENT DOCUMENTS

FOREIGN PATENT DOCUMENTS

| | | | |
|---|---|---|---|
| JP | 2007325900 | A | 12/2007 |
| JP | 2010284520 | A | 12/2010 |
| JP | 2013249894 | A | 12/2013 |

OTHER PUBLICATIONS

U.S. Appl. No. 11/619,780, Unpublished patent application.
U.S. Appl. No. 60/864,409, Unpublished patent application.
ASTM International , "F2398-11: Standard Test Method for Measuring Moment of Inertia and Center of Percussion of a Baseball or Softball Bat", USA Baseball ABI Protocol, edition approved Apr. 1, 2011, published May 2011. 3 pages.
ASTM International, , "F2844-11: Standard Test Method for Displacement Compression of Softball and Baseball Bat Barrels", USA Baseball ABI Protocol, edition approved Apr. 1, 2011. 3 pages.
Boombah , "2017 Boombah Boss Compressor T3 Bat Review", YouTube Video; URL: https://www.youtube.com/watch?v=aAFJAPkIISA, Jun. 2, 2017.
Boombah , "2017 Compressor T3 Slowpitch Bat", URL: https://www.boombah.com/us/equipment/bats/learn/2017-asa-boss-landing.html, web page visited Jan. 23, 2022.
Composites World , "Carbon-Kevlar Hinge, Besting metal hardware in weight, thickness, 3X load capacity and 1 million fatigue cycles", available at https://www.compositesworld.com/blog/post/carbon-kevlar-hinge- . Oct. 30, 2017. 5 pages.
European Space Agency , ""Passive Damped Deployment of Full Composite Structures"", available at http://www.esa.int/Our_Activities/Space_Engineering_Technology/Shaping_the_Future/Passive_Damped_Deployment_of_Full_Composite_Structures. Exact publication date unknown; website visited Feb. 9, 2018. 2 pages.
Russell, Daniel A., "Explaining the 98-mph BBS standard for ASA softball", Pennsylvania State University, Graduate Program in Acoustics, available at http://www.acs.psu.edu/drussel/bats/bbs-asa.html, Exact publication date unknown, last modified May 12, 2008; website visited Feb. 9, 2018; 6 pgs.
Tech Briefs , "Locking Mechanism for a Flexible Composite Hinge", available at https://www.techbriefs.com/component/content/article/tb/techbriefs/mechanics-and-machinery/26023, Dec. 1, 2016. 7 pages.
Worth , "Fastpitch Bats", Excerpt from 2010 Catalog.
Worth , "Quad Baseball Bat", Excerpt from 2009 Catalog.

* cited by examiner

BALL BATS WITH INNER BARREL STRUCTURES

BACKGROUND

Some existing bats for baseball or softball have an inner barrel structure positioned within an outer barrel structure. Such double-barrel bats provide some performance and durability advantages by allowing the outer barrel structure to provide a trampoline effect that is limited by the inner barrel structure, which forms a backstop to the movement of the outer barrel structure. In some existing double-barrel bats, the inner barrel structure is connected to the endcap of the ball bat or it extends through the entire length of the barrel. A potential disadvantage to connecting the inner barrel structure to the endcap is that the weight of the bat components near the endcap may increase the moment of inertia (MOI) of the bat more than the weight of components at other locations of the bat. It is desirable to control the MOI of a ball bat while also controlling the overall weight of the ball bat, and while controlling the performance of the ball bat.

SUMMARY

Representative embodiments of the present technology include a bat having a barrel shell and a frame structure. The barrel shell may include a barrel region of the bat and part of a tapered region of the bat. The frame structure may include a first portion positioned outside the barrel shell and a second portion positioned inside the barrel shell. In some embodiments, a distal end of the frame structure is in the barrel region but is longitudinally spaced from a distal end of the barrel shell. In some embodiments, the distal end of the frame structure is longitudinally spaced from an end cap of the bat. The barrel shell may flex or pivot relative to the second portion of the frame structure. In some embodiments, the only connection between the frame structure and the barrel shell within the barrel shell may be within the tapered region. In some embodiments, at least part of the second portion of the frame structure within the barrel shell may be spaced apart from the barrel shell by a gap that is radially positioned between the frame structure and the barrel shell.

Other features and advantages will appear hereinafter. The features described herein can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to ball bats with inner barrel structures, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to ball bats (such as baseball or softball bats) and composite materials, may not be shown or described in detail to avoid unnecessarily obscuring the relevant description of the various embodiments. Accordingly, embodiments of the present technology may include additional elements or exclude some of the elements described below with reference to FIGS. 1-4, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components. For purposes of the present disclosure, a first element that is positioned "toward" an end of a second element is positioned closer to that end of the second element than to a middle or mid-length location of the second element.

Figure 2:
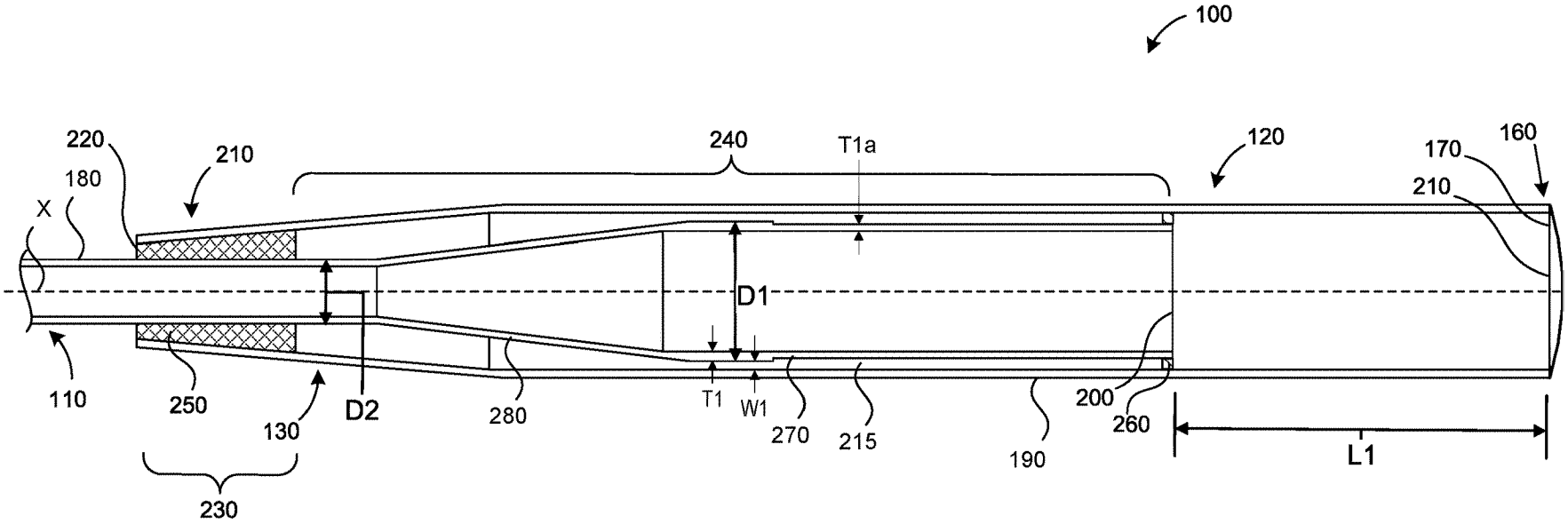
FIG. 2 illustrates a cross-sectional view of a portion of the ball bat shown in FIG. 1, in accordance with embodiments of the present technology.
Figure 3:
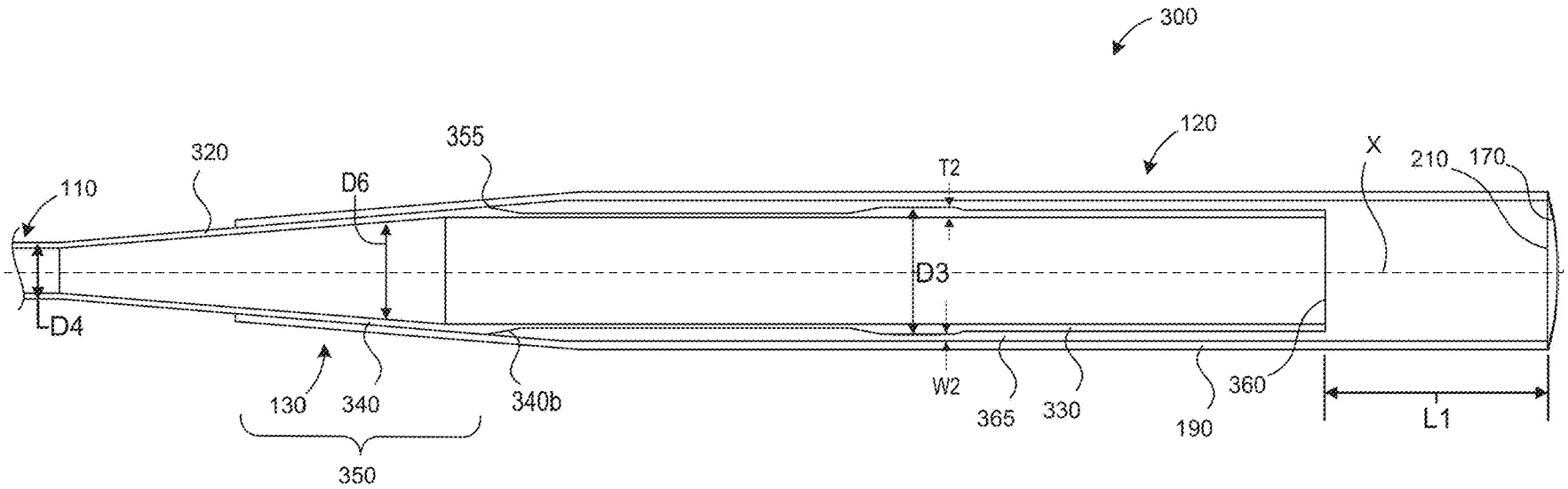
FIG. 3 illustrates a cross-sectional view of a portion of another ball bat configured in accordance with embodiments of the present technology.
Figure 4:
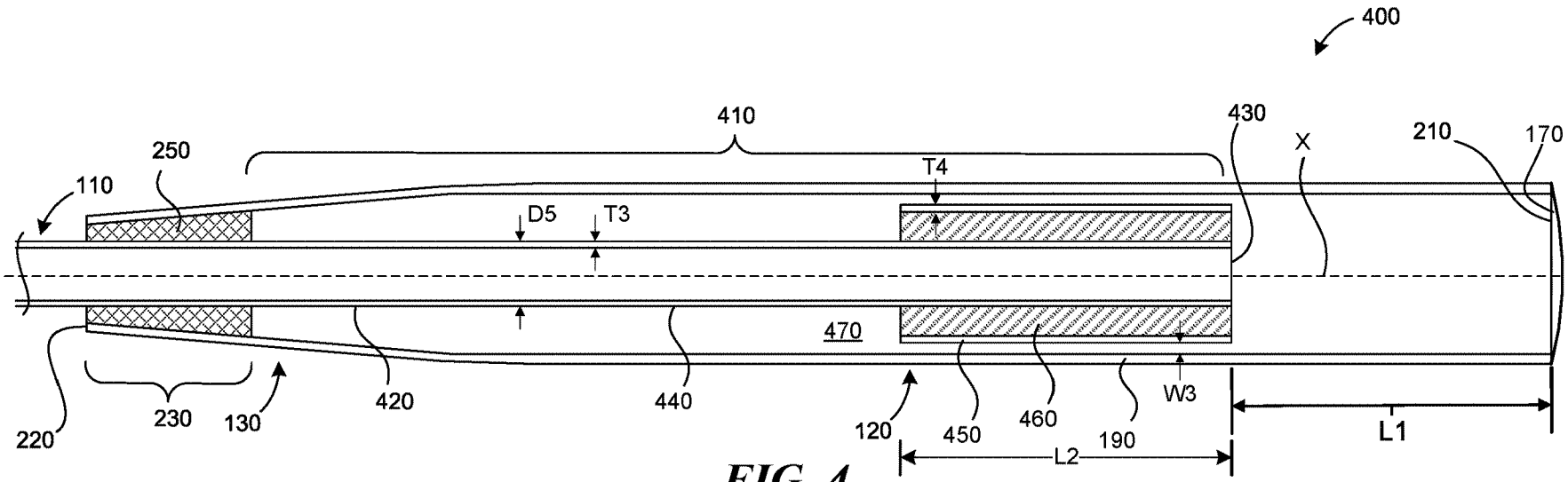
FIG. 4 illustrates a cross-sectional view of a portion of another ball bat configured in accordance with embodiments of the present technology.

As generally illustrated in FIGS. 2-4, embodiments of the present technology may include an inner barrel structure that is shorter than an overall outer barrel shell length, such that it does not reach the distal end of the outer barrel shell or contact an end cap. The inner barrel structure may be unsupported within a barrel region or hitting region of the outer barrel shell (or at least not rigidly connected to the outer barrel shell within the hitting region) to allow the inner barrel structure and the outer barrel shell to move relative to each other when hitting a ball. Configurations of such bats provide light weight with low MOI that help a player generate substantial bat speed while swinging the bat, while also meeting performance limitations associated with league rules.

Figure 1:
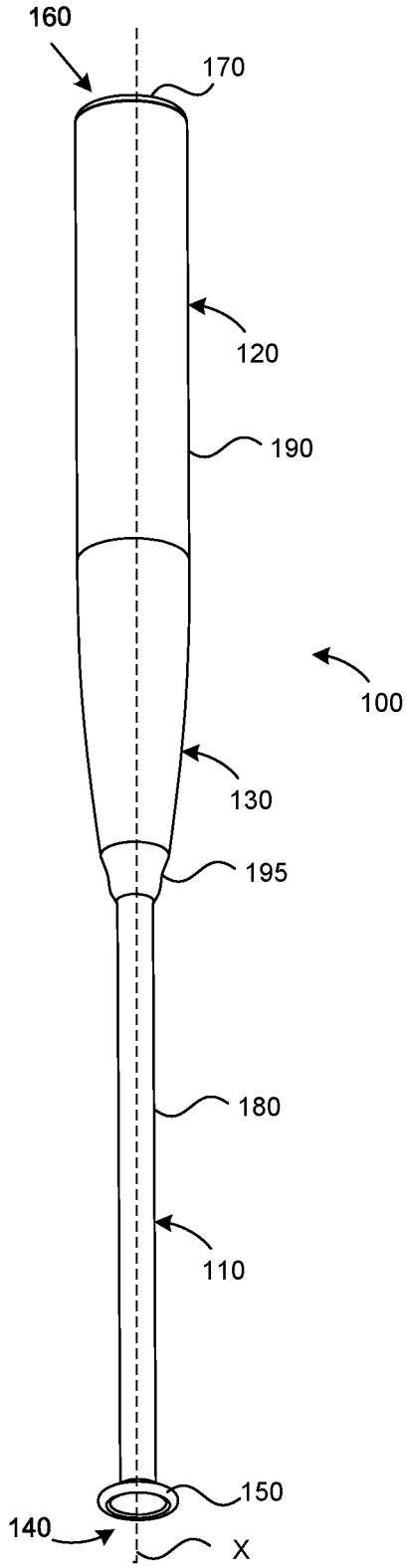
FIG. 1 illustrates a perspective view of a ball bat configured in accordance with embodiments of the present technology.

As shown in FIG. 1, a baseball or softball bat 100, herein collectively referred to as a "ball bat 100" or a "bat 100," includes a handle region 110, a barrel region 120, and a tapered region 130 between the handle region 110 and the barrel region 120. The handle region 110 is configured for a user to grasp when the user swings the bat 100. The handle region 110 may include a proximal end 140 of the bat 100 that is generally closer to a user during use. The bat 100 may include an end knob 150 or similar structure at the proximal end 140.

The barrel region 120 may be straight (non-tapered), and it constitutes at least part of a hitting surface or ball striking area of the bat 100. The barrel region 120 may include a distal end 160 of the bat 100 that is opposite the proximal end 140. The barrel region 120 may be generally hollow, as illustrated in FIGS. 2-4. The bat 100 may include a suitable plug or end cap 170 at the distal end 160 to close off the barrel region 120. The tapered region 130 transitions a larger outer diameter of the barrel region 120 toward a smaller outer diameter of the handle region 110. In some embodiments, there may not be a tapered region 130, such that the barrel region 120 is directly adjacent to the handle region 110. The bat 100 extends along a central longitudinal axis x between the proximal end 140 and the distal end 160.

The hitting surface or ball striking area of the bat 100 typically extends throughout the length of the barrel region 120, and may extend partially into the tapered region 130 of the bat 100. The ball striking area generally includes a "sweet spot," which is the impact location where the transfer of energy from the bat 100 to a ball is generally maximal, while the transfer of energy to a player's hands is generally minimal. The sweet spot is typically located near the bat's center of percussion (COP), which may be determined by the ASTM F2398-11 Standard. Another way to define the location of the sweet spot is between the first node of the first bending mode and the second node of the second bending mode. This location may be about four to eight inches from the distal end 160 of the bat 100, or other suitable distances. For ease of measurement and description, the "sweet spot" described herein coincides with the bat's COP.

The proportions of the bat 100, such as the relative dimensions of the barrel region 120, the handle region 110, and the tapered region 130, are not drawn to scale and may have any relative proportions suitable for use in a ball bat. Accordingly, the bat 100 may have any suitable dimensions. For example, the bat 100 may have an overall length of 20 to 40 inches, or 26 to 34 inches, or other suitable sizes. The overall diameter of the barrel region 120 may be 2.0 to 3.0 inches, or 2.25 to 2.75 inches, or other suitable sizes. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the ball bat 100, and may vary among users.

As described in further detail below with regard to FIGS. 2, 3, and 4, the bat 100 may include a frame structure 180 and a barrel shell 190. In some embodiments, the barrel shell 190 includes all of the barrel region 120 and at least a portion of the tapered region 130. The frame structure 180 may include all of the handle region 110 and, in some embodiments, it may include at least a portion of the tapered region 130.

The barrel shell 190 may be positioned over and around at least part of the frame structure 180, such that the frame structure 180 extends into the barrel shell 190. At least a portion of the handle region 110 is outside the barrel shell 190, as described in additional detail below. Accordingly, the frame structure 180 includes a first portion that is outside the barrel shell 190 and includes the handle region 110, and a second portion that is concentrically positioned inside the barrel shell 190. At least part of the second portion within the barrel shell 190 may be considered an insert in the barrel shell 190.

In some embodiments, the bat 100 includes a collar element 195 attached to the frame structure 180 or the barrel shell 190 to form a smooth transition between the surfaces of the barrel shell 190 and the frame structure 180 (such as the handle region 110). The collar 195 may serve an aesthetic purpose such as providing a smooth appearance for the bat 100.

In some embodiments, components of the ball bat 100 may be constructed from one or more composite or metallic materials. Components may be made from the same materials, or components within the same bat 100 may be made with different materials. Some examples of suitable composite materials include laminate layers or plies reinforced with fibers of carbon, glass, graphite, boron, aramid (such as Kevlar®), ceramic, or silica (such as Astroquartz®). In some embodiments, aluminum, titanium, or another suitable metallic material may be used to construct some or all of the ball bat 100. For example, in some embodiments, the barrel shell 190 may include one or more composite materials such as carbon fiber material, glass fiber material, or other composite material including other fibers. In some embodiments, the barrel shell 190 may include metal materials such as an alloy material (for example, aluminum alloy material), or other suitable metals, or thermoplastic material such as polycarbonate, nylon, or other suitable materials. In some embodiments, the frame structure 180 may include one or more of the same materials as the barrel shell 190, or the frame structure 180 may include other materials.

FIG. 2 illustrates a cross-sectional view of a portion of the ball bat 100 shown in FIG. 1, in accordance with embodiments of the present technology. To avoid obscuring details of the illustration, FIG. 2 does not show the optional collar 195, and only shows part of the handle region 110.

The frame structure 180 extends along the longitudinal axis x. The barrel shell 190 is positioned around, and concentric with, at least part of the frame structure 180. A first portion of the frame structure 180, which includes the handle region 110, is outside the barrel shell 190, and the remainder of the frame structure 180 (a second portion) extends into the barrel shell 190. In some embodiments, the frame structure 180 extends into the barrel shell 190, toward the distal end 160, beyond the tapered region 130, and into the barrel region 120. However, in some embodiments, the frame structure 180 does not extend the full length of the barrel region 120. Rather, a distal end 200 of the frame structure 180 (opposite the proximal end 140 of the bat 100) is longitudinally spaced from a distal end 210 of the barrel shell 190 by a distance L1, and it is longitudinally spaced from the end cap 170, such that the distal end 200 of the frame structure 180 does not extend to, or connect with, the end cap 170. In some embodiments, the distance L1 may be between five percent and twenty-five percent of the overall bat length (as measured between the proximal end 140 and the distal end 160).

In some embodiments, at least part of the frame structure 180 within the barrel shell 190 (such as within the barrel region 120) may be spaced apart from the barrel shell 190 by a gap 215 that is positioned radially between the frame structure 180 and the barrel shell 190. In some embodiments, the only connection or connections between the frame structure 180 and the barrel shell 190 within the interior of the barrel shell 190 is/are positioned toward a proximal end 220 of the barrel shell 190, such as within the tapered region 130. In other words, in some embodiments, the barrel shell 190 is only supported on the frame structure 180 at a location that is positioned toward the proximal end 220 of the barrel shell 190 (for example, within the tapered region 130). In some embodiments, the one or more connections form a pivot or flex region 230 within the tapered region 130 that facilitates relative movement (such as pivoting movement) between the barrel shell 190 and the frame structure 180. In some embodiments, the frame structure 180 may be characterized as having a cantilevered portion 240 extending from the flex region 230. The cantilevered portion 240 is rigidly attached to, or integral with, the remainder of the frame structure 180 (such as the handle region 110).

In some embodiments, the frame structure 180 is connected to the barrel shell 190 via a connection element 250, which may include a sleeve (such as a resilient sleeve) wrapped around the frame structure 180 and positioned toward the proximal end 220 of the barrel shell 190. In some embodiments, the connection element 250 may be positioned only within the tapered region 130 and may not extend beyond the tapered region 130. In some embodiments, the connection element 250 may include a thermoset polyurethane elastomer material, a thermoplastic polyurethane elastomer material, a foam material, a rubber material (such as natural rubber), a polycarbonate material, nylon, or another suitable material that can durably connect (and optionally, flexibly connect) the frame structure 180 to the barrel shell 190.

In operation, the barrel shell 190, the frame structure 180, or the connection element 250 can flex to facilitate relative motion (such as pivoting motion) between the barrel shell 190 and the frame structure 180. For example, during impact with a ball, the barrel shell 190 may move or flex until it momentarily contacts the frame structure 180 within the barrel region 120. The frame structure 180 may function as a backstop or limiter of the relative motion. Accordingly, the bat 100 can provide a trampoline or rebound effect that is limited by contact with the frame structure 180. The momentary contact may also produce a unique hitting sound.

In some embodiments, the bat 100 may include a centering element 260 positioned in the gap 215, which may include a ring of foam or other cushioning material positioned around, and concentric with, the distal end 200 of the frame structure 180. The centering element 260 may aid in maintaining concentricity of the frame structure 180 and the barrel shell 190, damping sound, or limiting relative motion between the frame structure 180 and the barrel shell 190. The centering element 260 may be connected or adhered only to the barrel shell 190 or only to the frame structure 180, or it may be connected or adhered to both. In some embodiments, the centering element 260 may be the only connection between the frame structure 180 and the barrel shell 190 outside the connection(s) within the flex region 230. The centering element 260 is optional and may be omitted in some embodiments, and it may be positioned at other locations along the frame structure 180.

In some embodiments, the frame structure 180 includes an inner barrel structure 270 attached to (or integral with) the handle region 110 along the longitudinal axis x of the bat 100. The inner barrel structure 270 may be spaced apart from the barrel shell 190 by the gap 215. The inner barrel structure 270 may have a greater diameter than the handle region 110. For example, the inner barrel structure 270 may have an outer diameter D1 that is greater than an outer diameter D2 of the remainder of the frame structure 180 (such as the handle region 110, excluding the end knob 150). The frame structure 180 may optionally include a tapered portion 280 that transitions the smaller diameter D2 to the greater diameter D1.

The inner barrel structure 270 may be spaced apart from the barrel shell 190 by a radially-oriented gap width W1. In some embodiments, the gap width W1 between the inner barrel structure 270 and the barrel shell 190 may vary depending on the intended sport. Generally, the gap width W1 may be between 0.01 inches and 0.375 inches, or other suitable dimensions. In embodiments intended for use in adult baseball, the gap width W1 may be between 0.01 inches and 0.09 inches to limit the movement or flex of the barrel shell 190, and to control performance (for example, to limit performance). In embodiments intended for use in softball (slow pitch or fast pitch), the gap width W1 may be between 0.075 inches and 0.375 inches, to allow more movement or flex of the barrel shell 190 and increased performance.

In some embodiments, a wall thickness T1 of the inner barrel structure 270 is uniform along the longitudinal axis x, such that the inner barrel structure 270 may have a consistent diameter D1, a consistent wall thickness T1, and a consistent gap width W1 along the longitudinal axis X from the tapered portion 280 to the distal end 200. However, in other embodiments, as generally illustrated in FIG. 2 for example, the wall thickness of the inner barrel structure 270 may vary along the longitudinal axis X between the tapered portion 280 and the distal end 200. For example, FIG. 2 generally illustrates a stepped change in thickness from T1 to a lesser thickness T1a, although other embodiments may include other changes in thickness.

The wall thickness T1 or T1a may vary depending on the intended sport. A thicker wall may provide a stiffer inner barrel structure 270, while a thinner wall may provide a more flexible inner barrel structure 270, depending also in part on the selected materials forming the inner barrel structure 270. For example, in embodiments intended for use in adult baseball, the wall thickness T1 may be between 0.1 inches and 0.2 inches, which may provide the benefits of the structure while controlling or limiting performance. In embodiments for use in softball (slow pitch or fast pitch), the wall thickness T1 may be between 0.05 inches and 0.125 inches to facilitate more deformation and an increase in performance.

FIG. 3 illustrates a cross-sectional view of a portion of a bat 300 configured in accordance with embodiments of the present technology. The bat 300 may be similar to the bat 100 described above with regard to FIGS. 1 and 2 in several ways. For example, the bat 300 may include the barrel shell 190 positioned around, and concentric with, at least part of a frame structure 320. The frame structure 320 may include the handle region 110 of the bat 300.

In some embodiments, the frame structure 320 includes an inner barrel structure 330 attached to, or integral with, the handle region 110 along the longitudinal axis x of the bat 300. The inner barrel structure 330 may have an outer diameter D3 that is greater than an outer diameter D4 of the handle region 110. To avoid obscuring details of the illustration, FIG. 3 does not show the optional collar 195, which may be included, and FIG. 3 only shows part of the handle region 110.

In some embodiments, the connection between the barrel shell 190 and the frame structure 320 may be more rigid than the connection described above regarding FIG. 2. For example, as generally illustrated in FIG. 3, in some embodiments, the barrel shell 190 may be connected to the frame structure 320 via overlapping tapered portions of the barrel shell 190 and the frame structure 320. The frame structure 320 may include a tapered portion 340 in which the smaller diameter D4 of the handle region 110 transitions toward a larger diameter, such as the diameter D3 of the inner barrel structure 330 or another diameter larger than D4. The tapered portion 340 of the frame structure 320 may engage the tapered region 130 of the barrel shell 190. An outer diameter of the tapered portion 340 of the frame structure 320 may be substantially equal to an inner diameter of the tapered region 130 of the barrel shell 190, which helps lock the barrel shell 190 to the frame structure 320. In some embodiments, the tapered portion 340 may be adhered to the tapered region 130 using a polyurethane adhesive, an epoxy adhesive, a methacrylate adhesive, or another suitable adhesive. In some embodiments, the barrel shell 190 and the frame structure 320 may be co-molded and co-cured.

Like the frame structure 180 described above regarding FIGS. 1 and 2, the frame structure 320 (including the inner barrel structure 330) extends into the barrel shell 190 beyond the tapered region 130, but the frame structure 320 does not extend the full length of the barrel region 120. Rather, a distal end 360 of the frame structure 320 (opposite the proximal end 140 of the bat 100) is longitudinally spaced from the distal end 210 of the barrel shell 190 by the distance L1 (described above), and it is longitudinally spaced from the end cap 170, such that the distal end 360 of the frame structure 320 does not extend to, or connect with, the end cap 170. The distal end 360 may be considered as floating freely within the barrel region 120 because it is not attached to the barrel region 120.

At least part of the frame structure 320 within the barrel shell 190 (such as within the barrel region 120) may be spaced apart from the barrel shell 190 by a gap 365 that is positioned radially between the frame structure 320 and the barrel shell 190. In some embodiments, the only connection between the barrel shell 190 and the frame structure 320 within the interior of the barrel shell 190 is within the tapered region 130, such that the inner barrel structure 330 is cantilevered in the barrel shell 190. The inner barrel structure 330 may be cantilevered from within the tapered region 130. The connection in the tapered region 130 forms a pivot region 350 within the tapered region 130 that facilitates relative movement (such as pivoting movement) between the barrel shell 190 and the frame structure 320. Upon impact with a ball, the barrel shell 190 may flex to momentarily contact the inner barrel structure 330, with the inner barrel structure 330 functioning as a backstop to the movement of the barrel shell 190. Accordingly, the bat 300 can provide a trampoline or rebound effect that is limited by contact with the inner barrel structure 330. The momentary contact may produce a unique hitting sound.

The inner barrel structure 330 may be spaced apart from the barrel shell 190 by a radially-oriented gap width W2. The gap width W2 may have similar dimensions or ranges of dimensions as the gap width W1 described above with regard to FIG. 2. In some embodiments, the wall thickness of the inner barrel structure 330 is generally uniform along the longitudinal axis X, such that the inner barrel structure 330 may have a consistent diameter D3, a consistent wall thickness T2, and a consistent gap width W2 along the longitudinal axis X from the tapered portion 340, the tapered region 130, or the pivot region 350 to the distal end 360. However, in other embodiments, as generally illustrated in FIG. 3 for example, the wall thickness of the inner barrel structure 330 may vary along the longitudinal axis X. FIG. 3 generally shows a tapered change in thickness, although other embodiments may include other changes in thickness. In some embodiments, the tapered portion 340 of the frame structure 320 can be a first tapered portion, and the frame structure 320 can include a second tapered portion **340*b* with an outer surface that tapers inwardly toward the longitudinal axis X from the first tapered portion 340 toward the distal end 360 of the frame structure 320. The second tapered portion 340*b* may form a proximal end 355 of the gap 365. The first tapered portion 340** may include an inner diameter D6 that varies along the longitudinal axis X.

FIG. 4 illustrates a cross-sectional view of a portion of a bat 400 configured in accordance with embodiments of the present technology. The bat 400 may be similar to the bat 100 described above with regard to FIGS. 1 and 2 in several ways. For example, the bat 400 may include the barrel shell 190 positioned around, and concentric with, at least part of a frame structure 420. The frame structure 420 includes the handle region 110, which is outside the barrel shell 190. The frame structure 420 extends into the barrel shell 190 along the longitudinal axis x beyond the tapered region 130 but it does not extend the full length of the barrel region 120. Rather, a distal end 430 of the frame structure 420 (opposite the proximal end 140 of the bat 100) is longitudinally spaced from the distal end 210 of the barrel shell 190 by the distance L1 (described above), and it is longitudinally spaced from the end cap 170, such that the distal end 430 of the frame structure 420 does not extend to, or connect with, the end cap 170. To avoid obscuring details of the illustration, FIG. 4 does not show the optional collar 195, which may be included, and FIG. 4 only shows part of the handle region 110.

In some embodiments, the frame structure 420 includes a tube element 440 and an inner barrel structure 450 that is attached to the tube element 440 via a resilient sleeve element 460. The resilient sleeve element 460 is positioned radially between the tube element 440 and the inner barrel structure 450. The inner barrel structure 450 may be positioned at the distal end 430 of the frame structure 420, such that it is spaced from the distal end 210 of the barrel shell 190 and the end cap 170. In some embodiments, the inner barrel structure 450 may extend along only a portion of the tube element 440. The inner barrel structure 450 and at least part of the tube element 440 may be spaced apart from the barrel shell 190 by a gap 470 that is positioned radially between the inner barrel structure 450 and the barrel shell 190, and radially between the tube element 440 and the barrel shell 190, and which extends along at least part of the longitudinal axis x of the bat 400.

In some embodiments, the resilient sleeve element 460 comprises an elastomeric foam material, or another suitable resilient material. In some embodiments, the stiffness of the resilient sleeve element 460 correlates with overall bat 400 performance. For example, a softer or lower durometer sleeve element 460 may enable more movement or deformation of the barrel shell 190 and produce a higher ball exit speed and a softer feel. A harder or higher durometer sleeve element 460 may reduce movement or deformation of the barrel shell 190 and act as a performance governor or regulator. In a specific example embodiment, a stiff inner barrel structure 450 combined with a soft flexible sleeve element 460 and a large gap width W3 between the barrel shell 190 and the inner barrel structure 450 would produce a soft feel, large barrel deformation, and control of overall performance.

In some embodiments, the tube element 440 may include composite material and it may have a diameter D5 ranging from 0.75 inches to 1.5 inches and a wall thickness T3 ranging from 0.05 inches to 0.125 inches. In some embodiments, the inner barrel structure 450 may include composite material or a metal material (such as aluminum, titanium, or magnesium). In some embodiments, the inner barrel structure 450 may have a length L2 ranging from two inches to eight inches, with a wall thickness T4 ranging from 0.05 inches to 0.125 inches. In some embodiments, the gap width W3 between the inner barrel structure 450 and the barrel shell 190 may range from 0.01 inches to 0.25 inches, depending on the intended sport (for example, and without limitation, a smaller gap width W3 may be used in baseball, while a larger gap width W3 may be used in softball).

The frame structure 420 may be connected to the barrel shell 190 in a manner similar to the connection between the frame structure 180 and the barrel shell 190 described above regarding FIG. 2. For example, in some embodiments, the only connection between the frame structure 420 and the barrel shell 190 within the interior of the barrel shell 190 may be positioned toward the proximal end 220 of the barrel shell 190. In some embodiments, the only connection between the frame structure 420 and the barrel shell 190 may be within the tapered region 130 (for example, only within the tapered region 130), such that the connection forms the pivot or flex region 230 within the tapered region 130 that facilitates relative movement (such as pivoting movement) between the barrel shell 190 and the frame structure 420.

In some embodiments, the frame structure 420 may be characterized as having a cantilevered portion 410 extending from the flex region 230. The cantilevered portion 410 may be rigidly connected to, or integral with, the remainder of the frame structure 420 (such as the handle region 110). In some embodiments, the frame structure 420 is connected to the barrel shell 190 via the connection element 250 wrapped around the frame structure 420 and positioned toward the proximal end 220 of the barrel shell 190. In some embodiments, the connection element 250 is positioned only within the tapered region 130 and does not extend beyond the tapered region 130.

In use, when the barrel shell 190 impacts a ball, the barrel shell 190 and the frame structure 420 may move relative to each other in a manner similar to the movement between the barrel shell 190 and the frame structure 180 described above. The inner barrel structure 450 may momentarily contact the barrel shell 190, and the resilient sleeve element 460 may absorb some of the impact forces. In some embodiments, the frame structure 420 may be generally rigid between the inner barrel structure 450 and the connection element 250.

However, in other embodiments, to further control relative movement between the components and to absorb impact, a portion of the frame structure 420 between the inner barrel structure 450 and the connection element 250 may be more flexible than the remainder of the frame structure 420. Such a flexible portion may be formed by providing a flexible geometry, by providing flexible fiber types or arrangements in the composite material, or by using a flexible resin in the flexible portion of the frame structure 420 (such as thermoplastic polyurethane or another suitable material). In some embodiments, such a flexible portion may be formed by replacing a section of the frame structure 420 with a flexible component, such as a thermoplastic injection molded component having lower stiffness than the remainder of the frame structure 420. In some embodiments, the flexible portion of the frame structure 420 may be positioned near the connection element 250, about 25 percent of the distance between the connection element 220 and the barrel structure 450, or at other suitable positions.

Specific details of several embodiments of the present technology are described herein with reference to ball bats. Embodiments of the present technology can be used in baseball, fast-pitch softball, slow-pitch softball, or other sports involving a projectile device or element such as a ball.

Ball bats configured in accordance with embodiments of the present technology provide several advantages. For example, they may have lower MOI due to the decreased weight toward the distal end of the barrel. Because the frame structures are not connected to the end cap, there is reduced risk of breaking the end cap or the frame structure breaking free from the end cap relative to bats that have a frame structure or inner barrel that connects to the end cap. Bats configured according to embodiments of the present technology may also be easier to construct than bats that include multiple connections between the inner barrel and an outer barrel shell. Bats configured according to embodiments of the present technology may also produce unique hitting sounds relative to other bat configurations.

Although specific dimensions are provided herein for some embodiments, other embodiments may include other suitable dimensions, and embodiments of the present technology are not limited to the specific dimensions disclosed herein.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, the frame structures may be made with multiple components joined together, or the frame structures may be single integral components. The frame structures may have any suitable geometries within the barrel shells, and they may have any suitable wall thicknesses or variations in wall thicknesses along their lengths.

Further, while advantages associated with certain embodiments of the disclosed technology have been described in the context of those embodiments, other embodiments may also exhibit such advantages, and not all embodiments need to exhibit such advantages to fall within the scope of the technology. Accordingly, the disclosure and associated technology may encompass other embodiments not expressly shown or described herein.

What is claimed is:

1. A bat extending along a longitudinal axis between a proximal end of the bat and a distal end of the bat, the bat comprising:

a barrel shell extending along the longitudinal axis between a proximal end of the barrel shell and a distal end of the barrel shell, the barrel shell including a barrel region of the bat and at least part of a tapered region of the bat; and a frame structure extending along the longitudinal axis, the frame structure including a first portion that is positioned outside the barrel shell and a second portion that is concentrically positioned inside the barrel shell, wherein the first portion includes a handle region of the bat; and an end cap attached to the distal end of the barrel shell; wherein:

(a) the frame structure extends within the barrel shell, toward the distal end of the barrel shell, beyond the tapered region, and into the barrel region;

(b) the frame structure is longitudinally spaced apart from the end cap;

(c) the frame structure comprises a first tapered portion and a second tapered portion, wherein (i) each of the first tapered portion and the second tapered portion is positioned within the tapered region of the bat, (ii) the first tapered portion tapers away from the longitudinal axis from the proximal end of the barrel shell to the second tapered portion, and (iii) the second tapered portion tapers toward the longitudinal axis from the first tapered portion toward a distal end of the frame structure;

(d) the first tapered portion includes an inner diameter that varies along the longitudinal axis; and (e) the only connection between the frame structure and the barrel shell within the barrel shell is a connection between the first tapered portion of the frame structure and an inner tapered portion of the barrel shell, wherein a portion of the frame structure including the second tapered portion and the distal end of the frame structure is cantilevered from the first tapered portion.

2. The bat of claim 1, wherein a width of an annular gap between the frame structure and the barrel shell varies between the second tapered portion and the distal end of the frame structure.

3. The bat of claim 1, further comprising a collar attached to the frame structure or the barrel shell to form a transition between an outer surface of the barrel shell and an outer surface of the frame structure.

4. The bat of claim 1, wherein the frame structure is rigidly connected to the barrel shell.

5. The bat of claim 1, wherein the distal end of the frame structure is longitudinally spaced apart from the distal end of the barrel shell by a distance between 5 percent and 25 percent of an overall bat length between the proximal end of the bat and the distal end of the bat.

6. The bat of claim 1, wherein the second portion of the frame structure comprises an inner barrel structure having an outer diameter that is larger than an outer diameter of the first portion of the frame structure.

7. The bat of claim 6, wherein the inner barrel structure comprises a non-uniform wall thickness that varies between the second tapered portion and the distal end of the frame structure.

8. A bat extending along a longitudinal axis between a proximal end of the bat and a distal end of the bat, the bat comprising:

a barrel shell extending along the longitudinal axis between a proximal end of the barrel shell and a distal end of the barrel shell, the barrel shell including a barrel region of the bat and at least part of a tapered region of the bat; and a frame structure extending along the longitudinal axis, the frame structure including a first portion that is positioned outside the barrel shell and a second portion that is concentrically positioned inside the barrel shell, wherein the first portion includes a handle region of the bat and the second portion includes a distal end of the frame structure;

wherein:

(a) the frame structure extends into the barrel region;

(b) the frame structure comprises a first tapered portion positioned inside the barrel shell and in the tapered region of the bat, wherein the first tapered portion tapers outwardly between a first outer diameter of the frame structure to a second outer diameter of the frame structure, wherein the first outer diameter is smaller than the second outer diameter;

(c) the frame structure further comprises a second tapered portion inside the barrel shell that narrows along the longitudinal axis from the second outer diameter of the frame structure toward the distal end of the frame structure;

(d) the first tapered portion is attached to a tapered portion of the barrel shell;

(e) a part of the second portion of the frame structure extending between the first tapered portion and the distal end of the frame structure is spaced apart from the barrel shell by an annular gap that is positioned between the part of the second portion and the barrel shell, wherein the second tapered portion forms a proximal end of the annular gap, and the gap extends to the distal end of the frame structure; and (f) the distal end of the frame structure is longitudinally spaced apart from the distal end of the barrel shell.

9. The bat of claim 8, further comprising an end cap attached to the distal end of the barrel shell, wherein the distal end of the frame structure is longitudinally spaced from the end cap.

10. The bat of claim 8, wherein the only connection within the barrel shell between the frame structure and the barrel shell is within the tapered region.

11. The bat of claim 8, wherein the second tapered portion extends only within the tapered region of the bat.

12. The bat of claim 8, wherein the second portion of the frame structure does not contact the barrel shell outside of the tapered region.

13. The bat of claim 8, wherein the second portion of the frame structure is cantilevered from within the tapered region of the bat.

14. The bat of claim 8, wherein the first tapered portion is attached to the barrel shell with adhesive.

15. The bat of claim 8, wherein the second portion of the frame structure comprises an inner barrel structure having an outer diameter that is larger than an outer diameter of the handle region.

16. The bat of claim 15, wherein a wall thickness of the inner barrel structure varies between the second tapered portion and the distal end of the frame structure.

17. A bat comprising:

a frame structure including a first portion and a second portion, wherein the first portion comprises a handle region of the bat, and the second portion comprises a distal end of the frame structure;

a barrel shell positioned around the second portion of the frame structure, the barrel shell having a proximal end and a distal end, wherein the barrel shell includes a barrel region of the bat; and an end cap attached to the distal end of the barrel shell;

wherein:

(a) the distal end of the frame structure is spaced from the end cap along a longitudinal axis of the bat;

(b) the second portion of the frame structure comprises an outwardly tapered portion adjacent to an inwardly tapered portion;

(c) the outwardly tapered portion is attached to a tapered portion of the barrel shell; and (d) at least part of the second portion of the frame structure within the barrel shell is spaced apart from the barrel shell by a gap that is positioned radially between the at least part of the second portion and the barrel shell, wherein the inwardly tapered portion forms a proximal end of the gap.

18. The bat of claim 17, wherein the second portion of the frame structure is cantilevered within the barrel shell such that the barrel shell can flex or pivot relative to the second portion of the frame structure.

19. The bat of claim 17, wherein the outwardly tapered portion is adhered to the tapered portion of the barrel shell.

20. The bat of claim 17, wherein the second portion comprises an inner barrel structure having a first outer diameter that is larger than a second outer diameter of the handle region.

21. The bat of claim 20, wherein a wall thickness of the inner barrel structure varies between the inwardly tapered portion and the distal end of the frame structure.

22. The bat of claim 17, further comprising a collar attached to the frame structure or the barrel shell to form a transition between an outer surface of the barrel shell and an outer surface of the frame structure.

* * * * *